United States Patent [19]

Labelle

[11] 4,408,369

[45] Oct. 11, 1983

[54] MOUNTING ASSEMBLY FOR A FOLDING CLOSURE

[76] Inventor: Henri M. R. Labelle, 50 Westmooreland Ave., Cornwall, Ontario, Canada, K6J 2G4

[21] Appl. No.: 295,230

[22] Filed: Aug. 21, 1981

[51] Int. Cl.[3] ..... A47H 15/00; E05D 13/02

[52] U.S. Cl. ..... 16/102; 16/103; 16/107; 160/196 R

[58] Field of Search ..... 160/35, 196 R, 196 D, 160/130, 196, 195, 197; 49/409-412; 16/87 R, 87.2 R, 87.4, 87.6, 87.8, 93 D, 91, 97, 102, 103, 104, 106, 107; 280/11.2, 11.27

[56] References Cited

U.S. PATENT DOCUMENTS 1,868,233 7/1932 Hungerford ..... 16/104

3,287,759 11/1966 Foltz ..... 49/409 X 3,570,579 3/1971 Matsushima ..... 160/35

3,720,254 3/1973 Smart ..... 160/196 X

*Primary Examiner*—Price C. Faw, Jr.

*Assistant Examiner*—Cherney S. Lieberman

*Attorney, Agent, or Firm*—Jack Paavila

[57] ABSTRACT

A mounting assembly for use in movably suspending a folding closure from a curved track. The mounting assembly has a wheel assembly for running on the track and a connecting member for connecting the wheel assembly to the closure. The wheel assembly is rotatable about the connecting member, and means are provided for limiting the rotational movement of the wheel assembly about the connecting member to prevent the wheel assemblies from turning sideways in the curved track while traversing it.

3 Claims, 8 Drawing Figures

MOUNTING ASSEMBLY FOR A FOLDING CLOSURE

BACKGROUND OF THE INVENTION

This invention is directed toward an improved mounting assembly for use in suspending a member, such as a closure, from a curved track.

The invention is also directed toward a folding closure incorporating the improved mounting assembly.

Closures, particularly folding closures, are often movably suspended from an overhead track by mounting assemblies which mounting assemblies include wheels running on the track. The closures can be folded up for storage, or unfolded to close an opening, by movement, via the wheels, along the track. The wheels on each of the mounting assemblies are usually free to rotate about a central vertical axis during movement on the track to minimize jamming.

On closure installations employing straight track lengths each mounting assembly requires only a single pair of wheels, each wheel pair mounted symmetrically about a vertical support rod, which rod connects the wheel pair to the suspended closure. The pair of wheels are rotatable about the rod, and all the wheel pairs allow the closure to move along the track. On closure installations employing curved track lengths however, the single pair of wheels on each mounting assembly often gets inadvertently turned through ninety degrees when moving through the curved track section. The wheels, as a result, end up with their axis of rotation parallel to, rather than perpendicular to, the track. This can lead to jamming of the closure in the curved section of the track, or at least to hindered movement of the closure with the turned wheel assemblies sliding, rather than rolling, along the track.

To prevent jamming of the closure during movement along the curved track sections, inadvertent rotation of the single wheel pair on the mounting assemblies, it is known to provide each mounting assembly with two pairs of wheels, one pair behind the other. The extra pair of wheels increases the operative track length of mounting assembly and this prevents the wheel assembly from turning sideways in the track. The extra pair of wheels on each mounting assembly however adds considerable expense to the closure, particularly on long folding closures used to close open store fronts.

SUMMARY OF THE INVENTION

It is therefore the purpose of the present invention to provide improved mounting assemblies which reduce, or eliminate, jamming of closures during movement along curved track sections, and which mounting assemblies are relatively inexpensive.

It is another purpose of the present invention to provide improved mounting assemblies which are simple in construction and installation.

In accordance with the present invention mounting assemblies are provided with a single pair of wheels and with means for limiting rotation of the wheel pair about the means connecting the wheels to the closure. The rotational movement of each wheel pair is limited so that the wheel pairs cannot turn transverse to the track, particularly when passing through the curved section of the track. However each wheel pair still has some rotational movement so that the wheel pairs can move relatively smoothly on the tracks, particularly on the curved sections.

Preferably, the means for limiting movement of the wheel pair about the means connecting the wheels to the closure comprise a head on the connecting means. The head is positioned between the pair of wheels and is shaped to provide surfaces against which the pair of wheels abut to limit their rotational movement.

The invention is particularly directed toward a mounting assembly for use in movably suspending a member from a curved track. The mounting assembly includes a wheel assembly with the wheel assembly comprising a mounting member with a pair of wheels rotatably mounted thereon. Means connect the wheel assembly to the member to be suspended from the track, the wheel assembly being rotatable relative to the connecting means about an axis which is perpendicular to the axis of rotation of the wheels. Means are provided for limiting the amount of rotation of the wheel assembly relative to the connecting means.

DESCRIPTION OF THE PREFERRED EMBODIMENT

Figure 1:
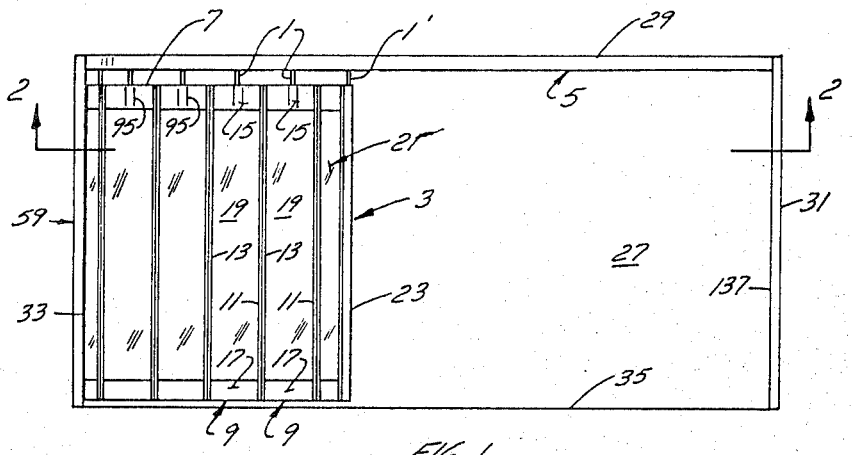
FIG. 1 is a front elevation view of an installed folding closure.
Figure 2:
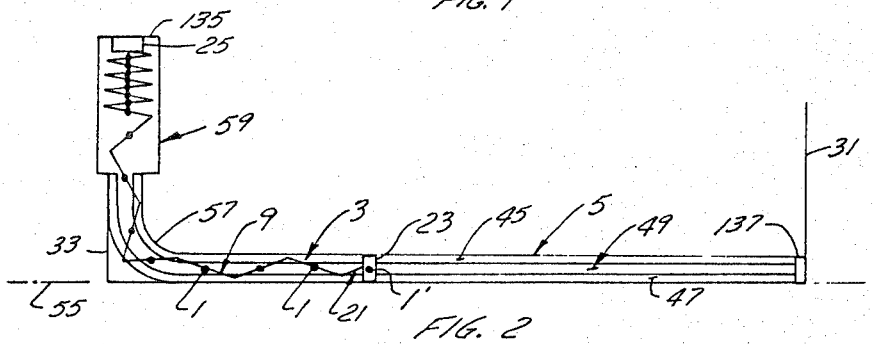
FIG. 2 is a cross-section view taken along line 2—2 of FIG. 1.

The mounting assembly 1 of the present invention is used to suspend a structure, such as a folding closure 3, from a curved track 5 as shown in FIGS. 1 and 2 so that the closure 3 may be moved along the track 5 in folding or unfolding the closure. A plurality of assemblies 1 are used to suspend the closure 3 from the track 5, the assemblies 1 spaced apart along the top edge 7 of the closure.

The folding closure 3 basically comprises a plurality of hingedly connected, narrow, main panels 9. Each main panel 9 has a male hinge member 11 on one vertical side and a female hinge member 13 on the other vertical side. The male and female hinge members 11, 13 of adjacent panels slidably interlock to form a hinge connecting the adjacent panels together. The main panel 9 includes a top plate 15 and a bottom plate 17 extending between the male and female hinge members 11, 13 at their top and bottom portions respectively. A transparent sheet 19 is mounted between the top and bottom plates 15, 17 and the hinge members 11, 13.

An end panel 21 is provided at each end of the closure 3. Each end panel 21 is similar in construction to the main panels 9 but is half the width of the main panels 9. A post 23, 25 is also provided at each end respectively of the closure 3. Each post 23, 25 is hingedly connected to the outer side of the adjacent end panel 21.

Figure 3:
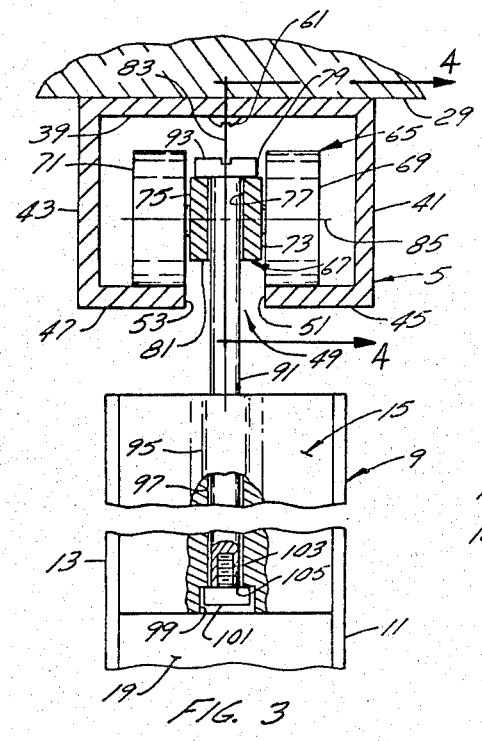
FIG. 3 is a partial cross-section view of the mounting assembly and track.

The closure 3 is adapted to be mounted in a position to close an opening 27. The opening 27 can be a store front by way of example, and is defined by a top surface 29, side walls 31, 33 and a floor 35. The track 5 is mounted to the top surface 29 defining the opening 27. The track 5 as seen in FIG. 3, preferably is of the type having an inverted, U-shaped cross-section with a top wall 39 and side walls 42, 43. A short flange 45, 47 extends inwardly from the bottom edge of each side wall 41, 43, respectively, defining a central slot 49 between their free edges 51, 53. The flanges 45, 47, are generally parallel to the top wall 39 and form tracks as will be described.

The track 5 extends straight along the top surface 29 adjacent the plane 55 of the opening 27 from one side wall 31 toward the other side wall 33. Near the other side wall 33, the track 5 curves inwardly ninety degrees, as shown at 57, to extend parallel to the side wall 33 to a pocket structure 59 mounted against the side wall 33 in which the closure 3 is stored when folded. The track 5 is mounted against the top surface 29 by suitable fasteners 61 which pass through the top wall 41 of the track 5 and into surface 29.

Figure 4:
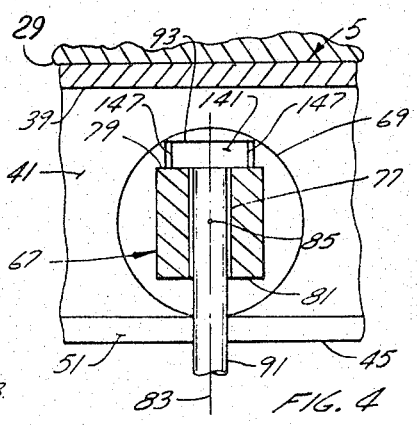
FIG. 4 is a partial cross-section view taken along line 4—4 of FIG. 3.

The closure 3 is suspended from the track 5 by a plurality of mounting assemblies 1. Each mounting assembly as shown in FIGS. 3 and 4 includes a wheel assembly 65 consisting of a mounting member, such as a block 67, and a pair of wheels 69, 71 rotatably mounted on opposed sides 73, 75 respectively of the block 67. A circular hole 77 extends through the center of the block 67 between the top and bottom 79, 81 of the block. The axis 83 of the hole 77 extends perpendicular to top and bottom surfaces 79, 81 and to the axis 85 of rotation of the wheels 69, 71. Hole axis 83 also intersects wheel axis 85.

The mounting assembly 1 also includes means for connecting the wheel assembly 65 to the closure 3. The connecting means comprises a hanger rod 91 which passes through the hole 77 in the block 67 and extends down below the block 67. A head 93 on the rod 91, larger in size than the hole 77, rests on the top surface 79 of the block 67 and prevents the rod from passing completely through the block. The lower portion of the rod 91 is fastened to the top plate 15 of a main panel 9. The rod 91 is fixed to the center of the top plate 15. Preferably, each top plate 15 has a central, vertically extending, tubular portion 95 with the rod 91 having a length sufficient to extend substantially through the hole 97 in the tubular portion. The bottom end of hole 97 is counterbored as shown at 99. A bolt 101 threads into a threaded bore 103 at the bottom end 105 of the rod 91 to connect the mounting assembly to the main panel 9.

Figure 6:
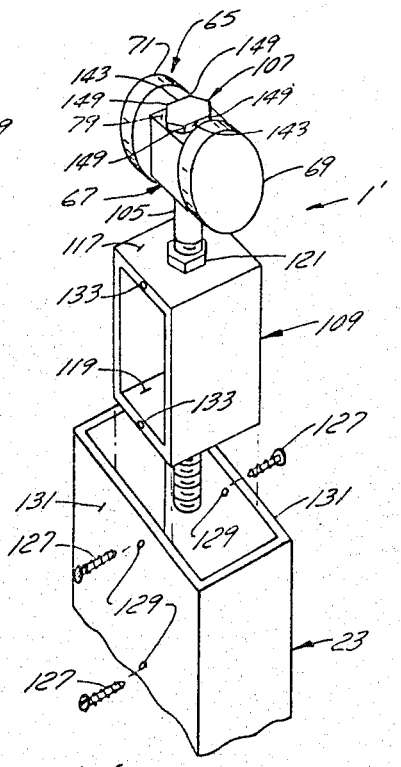
FIG. 6 is an exploded detail view of the mounting assembly.
Figure 5:
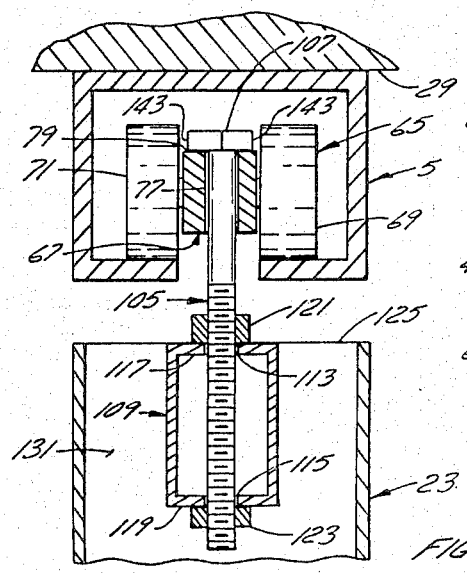
FIG. 5 is a partial cross-section view of another embodiment of the mounting assembly.

Each main panel 9 in the closure carries a mounting assembly 1. One of the end posts 23 also carries a mounting assembly 1'. The mounting assembly 1' used in the end post 23 is slightly modified from the mounting assembly 1 used in the main panels 9. Mounting assembly 1' as shown in FIGS. 5 and 6, includes a wheel assembly 65 as before consisting of block 67 and wheels 69, 71. Rod 91 however is replaced by a threaded bolt 105 which passes through the hole 77 in block 67. The head 107 of bolt 105 rests on the top surface 79 of block 67. A mounting section 109, preferably having a tubular rectangular shape is mounted on the lower portion of bolt 105. The bolt 105 passes through central holes 113, 115 in the ends 117, 119 respectively of the section 109. Nuts 121, 123 retain the section 109 fixed in position on the bolt 105.

The tubular section 109 is sized to fit snugly within the end post 23 from its upper end 125, with one end 117 of the section 109 near the upper end 125 of post 23. Fasteners 127, such as self-tapping screws, are threaded through holes 129 in the side walls 131 of post 23 to enter holes 133 in the end walls 117, 119 of section 109. The fasteners 127 fix the mounting assembly 1 to post 23.

The closure 3 is mounted from the track 5 by placing the wheel assemblies 65 of each mounting assembly 1 within the track 5 with the wheels 69, 71 resting on the flange tracks 47, 49 respectively. The other post 25 of the closure 3 is fixed to an end wall 135 of the pocket structure 59 as shown in FIG. 2. In the open position, the closure 3 is folded up in zig-zag fashion about the hinges and stored within pocket 59. In the closed position, the closure 3 is withdrawn from the pocket 59, along track 5 to extend across the opening 27 from the other side wall 3 to the one side wall 31. The one post 23 abuts against a post 137 on the one side wall 31. Suitable latch means (not shown) connect the end post 23 to fixed post 137 to retain the closure 3 in its closed position.

Figure 7:
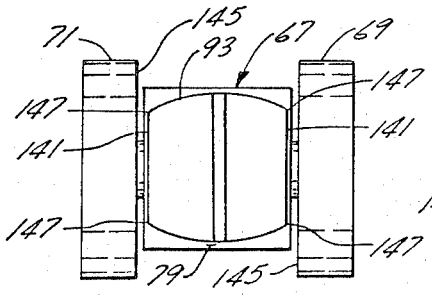
FIG. 7 is a plan view of the mounting assembly.
Figure 8:
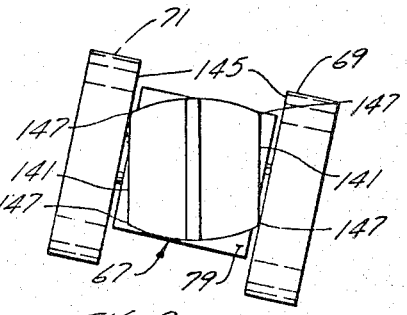
FIG. 8 is a view similar to FIG. 7, but with the wheel assembly rotated to its maximum extend.

To assist the closure 5 in moving along the curved section 57 of the track 5, each mounting assembly 1 has means for limiting the rotational movement of the wheel assembly 65 about the connecting means. These means limit the rotational movement of the block 67, and the attached wheels 69, 71, about the longitudinal axis 83 of the rod 91 or bolt 105 to no more than about thirty degrees in either direction from the path of travel along the track 5, and preferably to no more than about twenty degrees. The means for limiting the rotational movement of the wheel assembly 65 while mounted on the track 5, comprise providing a head 93, 107 on the rod 91, bolt 105 respectively that is positioned and shaped to cooperate with the wheels 69, 71 to limit their rotational movement. The heads 93, 107 are both shaped to have a pair of generally parallel side surfaces 141, 143 respectively. The heads 93, 107 are sized to have the side surfaces 141, 143 near, and parallel to the inner surfaces 145 of the wheels 69, 71 when the wheels move normally along the track as shown in FIG. 7. The heads 93, 107 are also sized to have the ends 147,149 of the side surfaces 141, 143 of the heads 93, 107 interfere with the wheels 69, 71 after the wheels and the block 67 have rotated about the rod 91 or bolt 105 the permitted amount as shown in FIG. 8. The side surfaces 141, 143 interfere with the wheels 69, 71 at locations spaced transversely from the axis of rotation of the wheels. When the wheels 69, 71 abut on the head 93, or 107, the wheels are prevented from rotating any further thereby limiting the rotational movement of the wheel assembly 165. In limiting the rotational movement of the wheel assembly 65, the wheel assemblies 65 are prevented from turning sideways in the track 5 when moving through the curved section 57 of the track.

I claim:

1. A mounting assembly for use in movably suspending a member from a curved track comprising: a wheel assembly, the wheel assembly comprising a mounting member with a pair of wheels rotatably mounted on the mounting member, the wheel assembly adapted to run on the curved track; means connecting the wheel assembly to the member to be suspended from the curved track, the wheel assembly rotatable relative to the connecting means about a vertical axis which is perpendicular to the axis of rotation of the wheels; and means on the connecting means for interfering directly with at least one of the wheels on the mounting member, after the wheel assembly has rotated a limited amount relative to the connecting means, to limit further rotation of the wheel assembly.

2. A mounting assembly as claimed in claim 1 wherein the connecting means comprises an elongated cylindrical member having an enlarged head, the cylindrical member freely passing down through a hole in the mounting member with its enlarged head resting on the mounting member, the interfering means comprising portions of the enlarged head.

3. A mounting assembly as claimed in claim 2 wherein the axis of rotation of the wheels intersects the vertical axis of rotation of the wheel assembly, and wherein the interfering portions of the enlarged head are laterally spaced from the axis of rotation of the wheels in a non-rotative position of the wheel assembly.

* * * * *